US006183105B1

(12) United States Patent
Parker

(10) Patent No.: US 6,183,105 B1
(45) Date of Patent: Feb. 6, 2001

(54) FLASHLIGHT AND CHARGER

(75) Inventor: David Parker, Torrance, CA (US)

(73) Assignee: Pelican Products, Inc., Torrance, CA (US)

( * ) Notice: Under 35 U.S.C. 154(b), the term of this patent shall be extended for 0 days.

(21) Appl. No.: 09/343,570

(22) Filed: Jun. 30, 1999

(51) Int. Cl.[7] ..... F21L 4/08
(52) U.S. Cl. ..... 362/183; 362/205; 362/204
(58) Field of Search ..... 362/183, 202, 362/204, 205; 320/113–115

(56) References Cited

U.S. PATENT DOCUMENTS

| | | | |
|---|---|---|---|
| D. 282,289 | 1/1986 | Verdier | D26/46 |
| D. 351,675 | 10/1994 | Sharrah et al. | D26/38 |
| D. 353,216 | 12/1994 | Sharrah et al. | D26/37 |
| D. 394,122 | 5/1998 | Concari et al. | D26/38 |
| 1,680,169 | 8/1928 | Osean | 362/188 |
| 2,016,819 | 10/1935 | Meginniss | 362/158 |
| 2,097,222 | 10/1937 | Tompkins et al. | 362/187 |
| 2,272,907 | 2/1942 | Deibel | 362/194 |
| 2,312,463 | 3/1943 | Zdansky | 362/183 |
| 2,339,356 | 1/1944 | Sachs | 362/187 |
| 2,813,265 | 11/1957 | Finks | 340/473 |
| 2,931,005 | 3/1960 | Saurwein et al. | 439/660 |
| 2,945,944 | 7/1960 | Gillespie | 362/188 |
| 3,217,224 | 11/1965 | Sherwood | 320/115 |
| 3,659,180 | 4/1972 | Urbush | 320/115 |
| 3,787,678 | 1/1974 | Rainer | 362/183 |
| 3,825,740 | 7/1974 | Friedman et al. | 362/183 |
| 3,829,676 | 8/1974 | Nelson et al. | 362/183 |
| 4,060,723 | 11/1977 | Nelson | 362/205 |
| 4,092,580 | 5/1978 | Prinsze | 320/115 |
| 4,171,534 | 10/1979 | Strowe | 362/183 |
| 4,203,150 | 5/1980 | Shamlian | 362/183 |
| 4,225,814 | 9/1980 | Gantz et al. | 320/115 |
| 4,265,984 | 5/1981 | Kaye | 429/178 |
| 4,286,311 | 8/1981 | Maglica | 362/205 |
| 4,325,107 | 4/1982 | MacLeod | 362/183 |
| 4,345,304 | 8/1982 | Penney et al. | 362/183 |
| 4,463,283 | 7/1984 | Penney et al. | 315/87 |
| 4,472,766 | 9/1984 | Hung | 362/158 |
| 4,495,551 | 1/1985 | Foltz | 362/205 |
| 4,777,582 | 10/1988 | Sharrah | 362/205 |
| 4,819,139 | 4/1989 | Thomas | 362/183 |
| 4,819,141 | 4/1989 | Maglica et al. | 362/207 |
| 4,843,298 | 6/1989 | Brauch et al. | 320/115 |

(List continued on next page.)

FOREIGN PATENT DOCUMENTS

| | | |
|---|---|---|
| 0 768 724 A2 | 4/1997 | (EP) . |
| 0 679 237 B1 | 9/1997 | (EP) . |
| 2 372 382 | 11/1976 | (FR) . |
| 411218 | 6/1934 | (GB) . |

OTHER PUBLICATIONS

Advertisement for Mini Tekna–Lite, No date.
Advertisement for Pro–Charger Systems, No date.
Advertisement for Tekna flashlights (Golderbergs?), No date.
Law & Order; Apr. 1987, p. 26.
Vari–Probe Code Four Adapter, No date.
Lumilite advertisement, No date.

*Primary Examiner*—Alan Cariaso
(74) *Attorney, Agent, or Firm*—Oppenheimer, Wolff & Donnelly LLP

(57) ABSTRACT

A flashlight which includes a rechargeable battery and is loaded from the base of the body of the flashlight. The contacts are on the barrel of the flashlight and are for contact with the recharging device. On top of the battery there is a tangentially directed spring member for contacting a ring of the top contact of the battery and a permanently located stud member in the central location. An enlarged head is located between the intermediate portion which is located between the head and the barrel. The intermediate portion receives the switching device.

22 Claims, 5 Drawing Sheets

U.S. PATENT DOCUMENTS

| | | | |
|---|---|---|---|
| 4,843,526 | 6/1989 | Price, III | 362/187 |
| 4,870,550 | 9/1989 | Uke | 362/158 |
| 4,888,670 | 12/1989 | Sharrah | 362/205 |
| 4,899,265 | 2/1990 | Maglica | 362/187 |
| 4,942,505 | 7/1990 | Maglica | 362/187 |
| 4,970,073 | 11/1990 | Arzur et al. | 429/152 |
| 5,008,785 | 4/1991 | Maglica et al. | 362/183 |
| 5,165,048 | 11/1992 | Keller et al. | 320/113 |
| 5,171,086 | 12/1992 | Baloochi | 362/188 |
| 5,432,689 | 7/1995 | Sharrah et al. | 362/183 |
| 5,446,633 * | 8/1995 | Hanggi | 362/183 |
| 5,486,432 | 1/1996 | Sharrah et al. | 429/99 |

* cited by examiner

2/5

43
40
141
139
142
23
132
10
22
15
26
134
100
19
21
18
31
32
42
33

FIG. 13
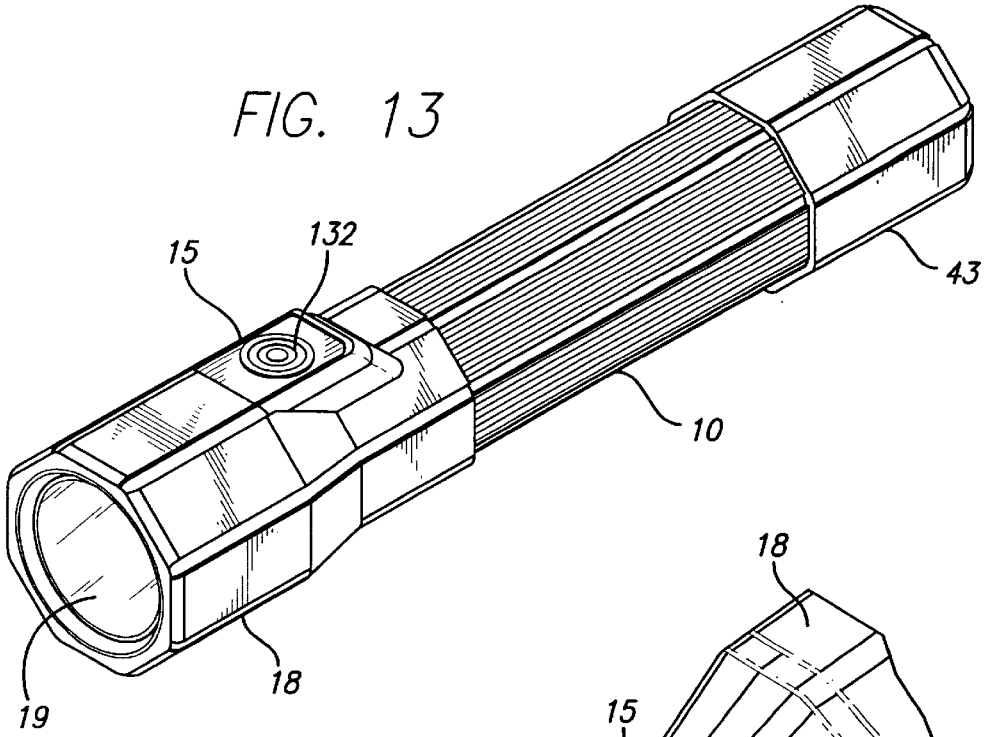
FIG. 18
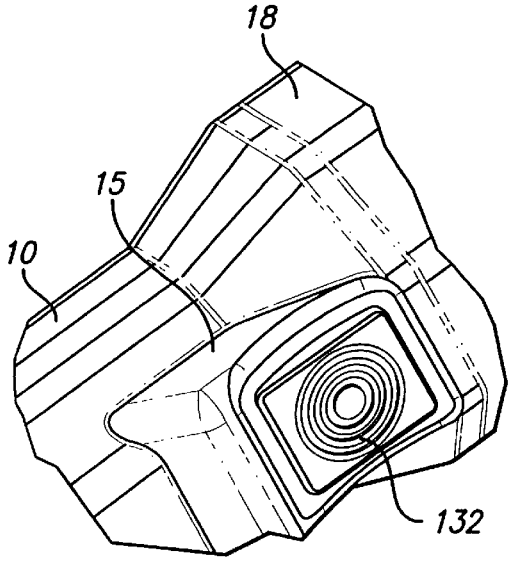
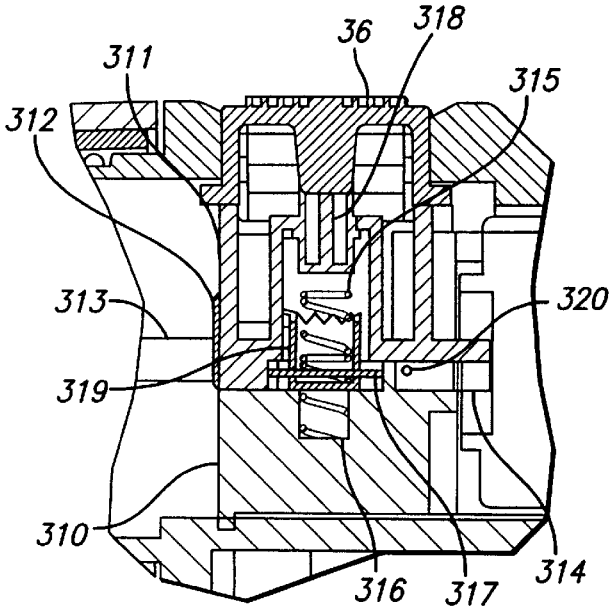
FIG. 19

FLASHLIGHT AND CHARGER

This application relates to patent application Ser. Nos. 09/345,187, filed on Jun. 30, 1999, and entitled "FLASHLIGHT AND CHARGING SYSTEM" and 09/343,571, filed: Jun. 30, 1999 and entitled "CHARGEABLE FLASHLIGHT". The contents of these applications are incorporated by reference herein.

BACKGROUND OF THE INVENTION

This invention relates to a rechargeable flashlight. In particular, it relates to a flashlight for use in relatively rugged conditions.

Many flashlight configurations are known. Additionally, different flashlight configurations arc known which are rechargeable. There are also different forms of charging device for use with flashlights. The different combinations provide for a configuration of flashlight and charging mechanism, which is not as optimum as possible in the sense that the flashlight and charger can be easily set up as a unit. Moreover, they are not convenient for rugged use, for instance, by law enforcement officers, the military and firefighters.

The various flashlights are often not as simple and inexpensive to manufacture as desirable, while at the same time having effective characteristics of longevity and ability to work in harsh conditions and being subjected to shock, and the need for quick recharging as necessary.

The invention is directed to providing a flashlight and recharging system which minimizes the disadvantages of known flashlights.

SUMMARY OF THE INVENTION

By the present invention, there is provided a flashlight which minimizes the disadvantages of known flashlights.

A rechargeable battery flashlight is provided with a body being a barrel, an intermediate section and a head. The flashlight is loaded with a battery pack from the rear. There are contacts on the barrel opposite to a switch device in the intermediate section. A leaf spring is located at the top of the battery and another helical spring is located at the bottom of the battery. The springs retain the battery in a shock absorbing mode. The helical spring at the bottom is located between the base of the barrel and the battery and is not in an electrical contact with the battery. The leaf spring at the top is located between the battery and a switching device which is transversely mounted in an intermediate section above the barrel of the flashlight.

The leaf spring at the top is in contact with the battery. A solid stud below the switching device contacts the central contact of the battery, and a peripheral tangential leaf spring contact makes electrical contact with a peripheral contact of the battery which is connected through an elongated strip with the lower terminal of the battery pack.

Above the intermediate section is located an enlarged head which includes a lens and a bulb.

A charger is provided to connect with the contacts on the intermediate portion when in recharging mode. The charger device includes arms or jaws, which preferably engage the flashlight around the barrel so that the contacts on the charger can make electrical contact with the contacts on the barrel of the flashlight.

The invention is further described with reference to the accompanying drawings.

BRIEF DESCRIPTION OF THE DRAWINGS

FIG. 13 is a perspective exploded view of the flashlight.

FIG. 18 is a detailed view showing the push button for the switch for the flashlight.

FIG. 19 is a detailed view showing the switch for the flashlight and the spring mechanisms associated with the switch.

DETAILED DESCRIPTION OF THE PREFERRED EMBODIMENT

Figure 1:
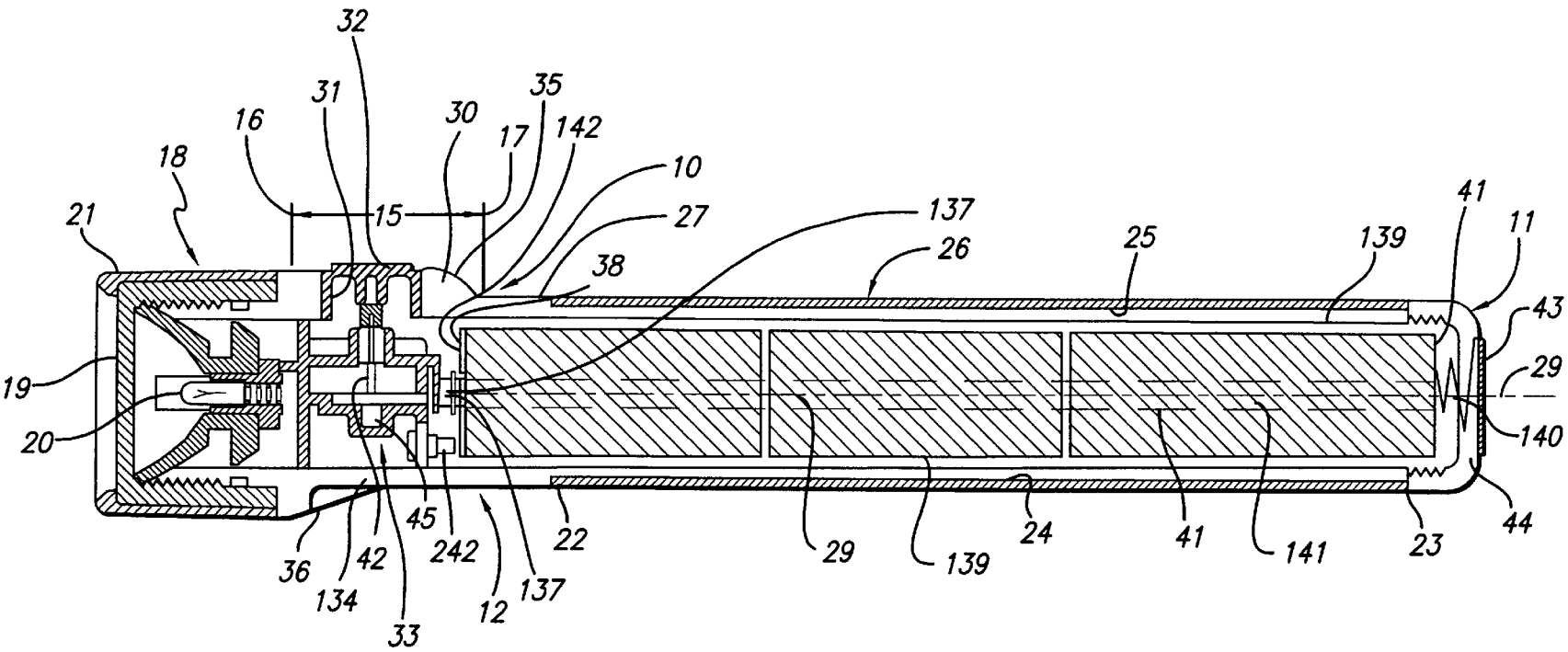
FIG. 1 is a cross-sectional view of a flashlight in accordance with the invention showing the body which includes the barrel and intermediate section above the barrel and an enlarged head above the intermediate section. A battery pack is shown in the barrel.

A rechargeable flashlight including a body 10 which has a substantially regular first cross-sectional area as defined between the base 11 of the body 10 and the top portion of the body as defined in the area 12. The first cross-sectional area is defined on the outside by an octagonal configuration 13 and the internal configuration is formed substantially as a circular structure 14. The body 10 includes a barrel.

Above the body portion 10 there is an intermediate portion 15 defined by a second crosssectional area. The intermediate portion 15 is defined between the ends 16 and 17 of the arrows show in FIG. 1. Above the intermediate portion 15 there is a head portion 18 which is relatively enlarged. The intermediate portion includes a protrusion 60 on the side, namely on one of the octagonal sides of the flashlight. The protrusion is for housing, in part, a switching device.

The head portion 18 includes a lens 19 and within the lens a bulb 20. There is also located a shroud 21 which is over-molded on the lens 19. This provides increased protection to the lens 19. A lens O ring 100 is provided between the head 18 and the intermediate portion 15 to facilitate a tight fit and reduce moisture and dust ingress.

The body portion 10 outside surface octagonal configuration includes two circumferential lips 22 and 23. Lip 22 is located substantially at the uppermost portion of the body portion 10 around the outside. The lip 23 is located towards the base portion 11 around the outside of the body portion 10. These inset lips provide a receiving area 24 for receiving an extruded flexible and switchable sleeve 25 which can fit within the circumferential trough formed between the lips 22 and 23. The outside surface 26 of the sleeve 25 is substantially flush with the outside surface 27 of the body portion 10 when in position between the lips.

The intermediate portion 15 has a second cross-sectional area which is relatively larger than the first cross-sectional area of the body portion 10. The second cross-sectional area extends relatively to one side of the longitudinal axis 29 running through the body portion 10 and it is this extended portion 60 which acts to receive the switching device.

At the intermediate portion 15 there is provided a transverse aperture 31 through which a manually operable movable switching arm and push button 32 of the switch device or assembly 33 is located. A switch pad button cover 132 is provided to the movable arm 32. The manually operable switch arm 32 can be depressed to activate a spring operated switch assembly 33 so as to close and open electrical contacts in the switch device 33. The opposite end of the switch device 33 is connected with electrical contacts 134, which arc mounted as a pair adjacent each other transversely in the extended portion 15 of the body, namely the intermediate portion below the head 18. Connecting the protrusion 60 of the extended intermediate portion 15 with the body portion 10, there is a relatively tapered zone 35. Connecting the extended intermediate portion 15 with the head potion 18, there is also a tapered zone 36. The head portion 18 is formed such as to have a relatively greater cross-section that the cross-section than the intermediate portion 15. The location of the enlarged portion 18 is relatively centrally formed relative to the longitudinal axis 29.

The trailing end of the switch device assembly 33 includes a rigid central stud-like contact 137, which is directed downwardly towards a top portion 38 of a battery pack 139. There is a helical spring 140 mounted at the base area 11 of the body and is directed to the base 41 of the battery pack 139. As such, the helical spring 140 and the central contact 137 in opposition to each other, and the battery pack 139 is biased towards to contact 137 by the helical spring in order to maintain electrical contact when subjected to an impact.

There is also an elongated contact strip 141 which runs up the inside of the battery and connects the negative end of the lower battery cell with circular ring 142 at the top of the battery. The battery pack 139 connects with the switch assembly 33 appropriately through a leaf spring 242 mounted tangentially relative to the battery pack 139.

When the operational arm and push button 132 of the switch 33 acts to press and depress the plunger mechanism 42 of the switch device assembly 33, the circuit connecting the battery pack 139 between the bulb 20 is made or broken as established through the switch device assembly 33 and electrical contacts within the switch device assembly 33. The operation of the switch assembly 33 is transverse or relatively radial to the longitudinal axis 29 of the body of the flashlight. The operational arm and push button 32 and the plunger 42 acts relatively radially low transversally and the operational arm and push button 32 is relatively located in a radially opposite position to the contacts 34 on the flashlight.

The switch assembly 33 include the plunger 42 which operates with one or more springs 45 which are helically and coaxially mounted around the plunger 42. Suitable contacts 45 are provided for opening and closing and making the flashlight circuit between the battery and the bulb.

A suitable button padding 132 is provided to the arm and push button 32 such as to provide for positive engagement by finger operation of a user. The outside of the flashlight therefore has the extruded sleeve 25, a suitable padding on the operational button and a shroud 21 around the lens. Thus, the outside of the flashlight is suitably protected for rugged use. Within the flashlight mechanism as indicated, the battery is suitably buffered for shock between the springs 37 and 140.

The operation of the switch assembly 33 in a manner transverse to the longitudinal direction of the flashlight also provides for effective and positive movement. By locating the switch 33 in the intermediate section of the flashlight, there is greater width and cross-sectional area to accommodate the switch device 33 in a convenient place. Having the location of the switch 33 radially opposite the contact also provides for an effective assembly and location of these two components.

At the base 11 of the body 10, there is a cap 43 which fits over an aperture 44 in the base of the body 10 and is screw connected to the base of the body 10. The battery pack 139 fits into the base through the rear entry into the flashlight. The helical spring 140 is not in electrical with the battery pack 139.

Figure 2:
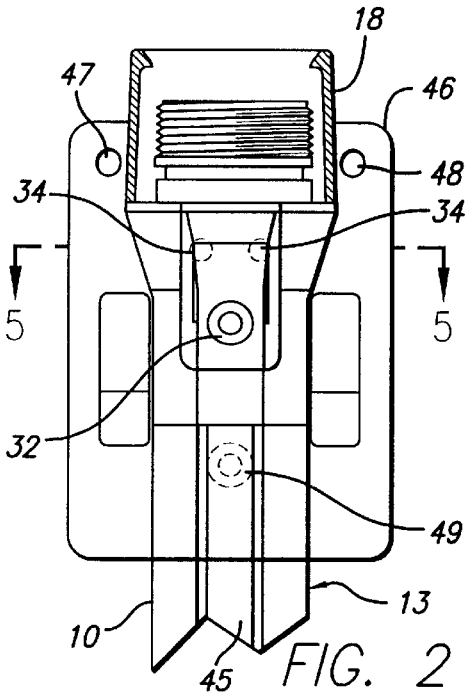
FIG. 2 is a front view of a portion of the flashlight located with a recharging device, the recharging device having jaws, which, are secured to the barrel of the flashlight.
Figure 3:
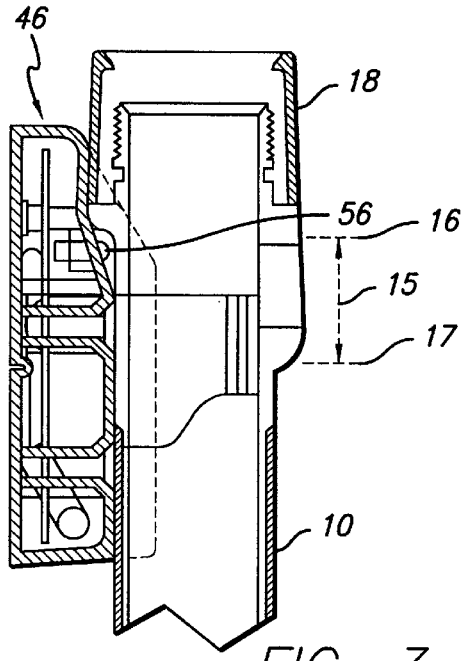
FIG. 3 is a cross-sectional side view of a portion of the flashlight shown with a recharging device.
Figure 4:
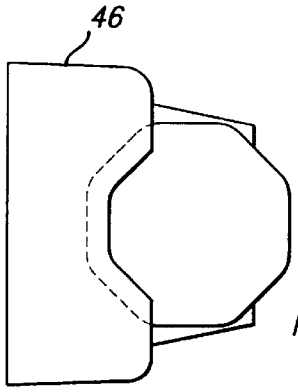
FIG. 4 is a view from the top of the combination of the flashlight and charger.
Figure 5:
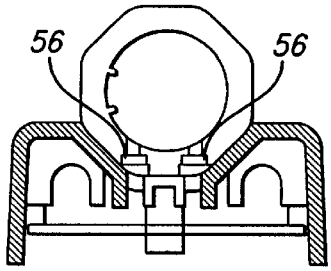
FIG. 5 is a view along line 5—5 showing the flashlight connected with the contacts of the charger without the jaws of the charger.

As can be seen in FIG. 2 the two contacts 134 are transversely located relative to each other on one face of the octagonal surface 13 of the body 10. The operating button 132 of the switch device 33 is shown in the front on the panel 45 of the body 10.

Figure 6:
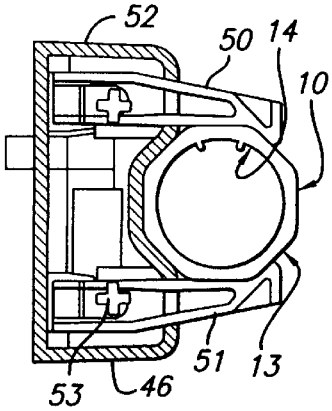
FIG. 6 is a cross-sectional view showing the charger connected with the flashlight and the jaws of the charger anchored around the body of the flashlight.
Figure 7:
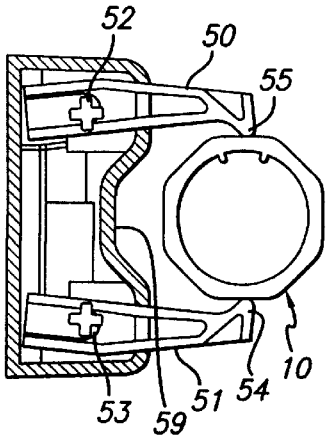
FIG. 7 is a cross-sectional view showing the jaws of the charger opened about respective pivot points as the flashlight is located at the tips of the end of the jaws.
Figure 8:
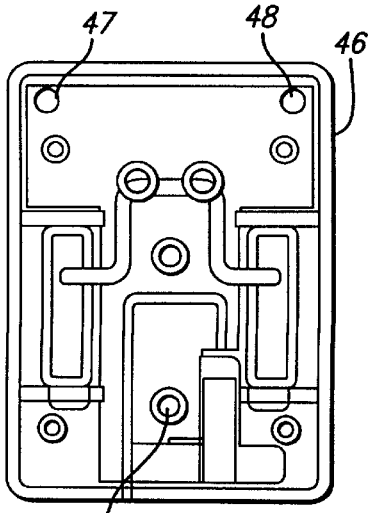
FIG. 8 is a rear view of the charger unit.
Figures 9, 10, 11, 12:
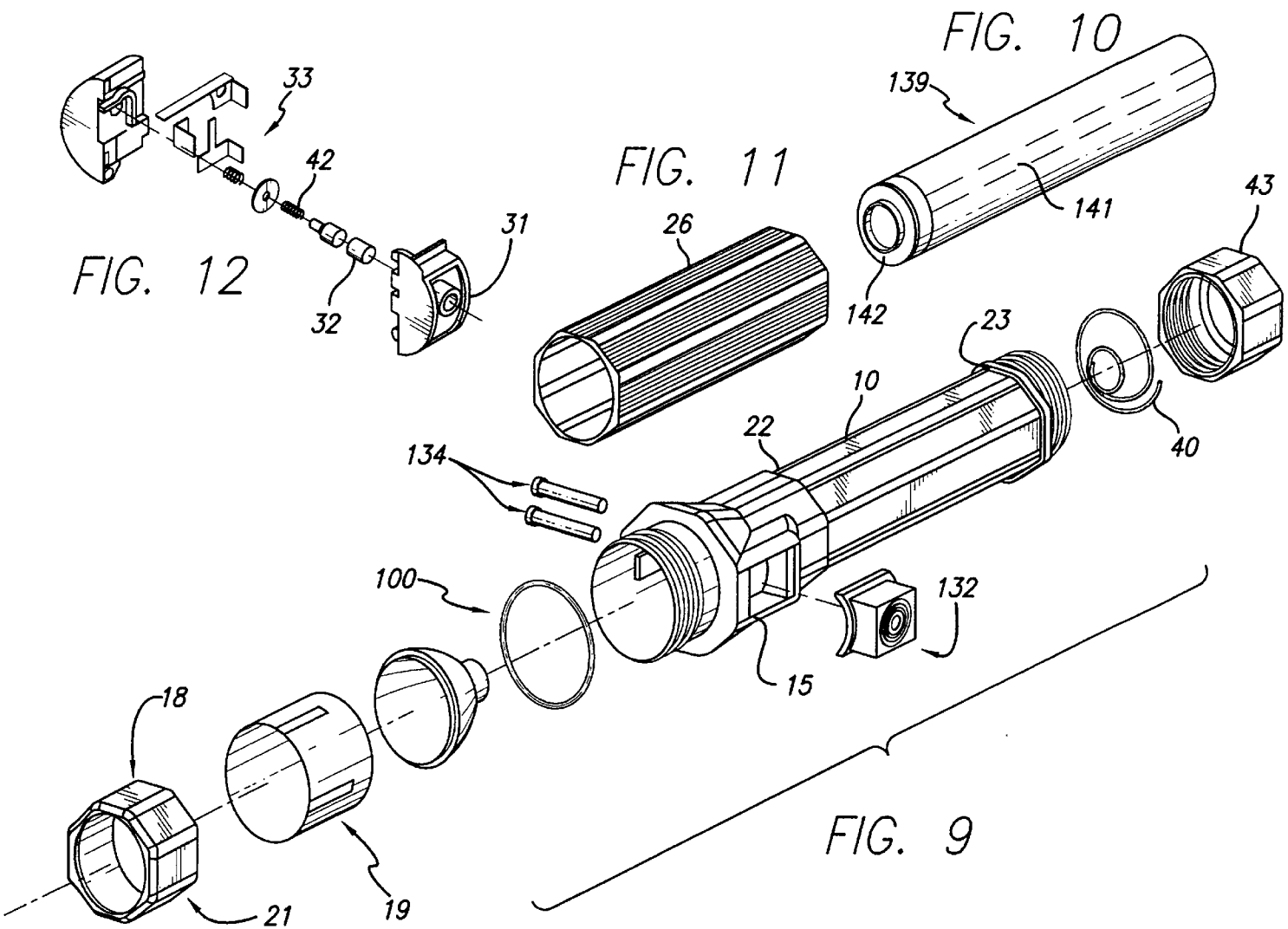
FIG. 9 is a perspective exposed view of the flashlight and its components.
FIG. 10 is a perspective view of the battery pack showing the elongated strip.
FIG. 11 is a perspective view of the sleeve.
FIG. 12 is a perspective exploded view of the switch device components.
Figure 14:
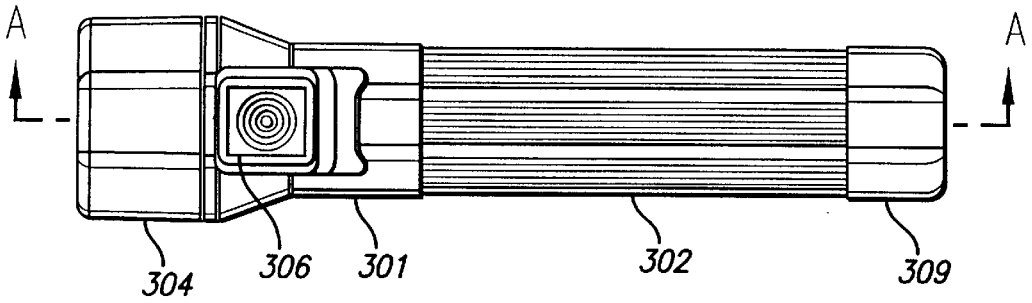
FIG. 14 is a side view of the flashlight viewed with the operable portion to activate the switch shown on the front face.
Figure 15:
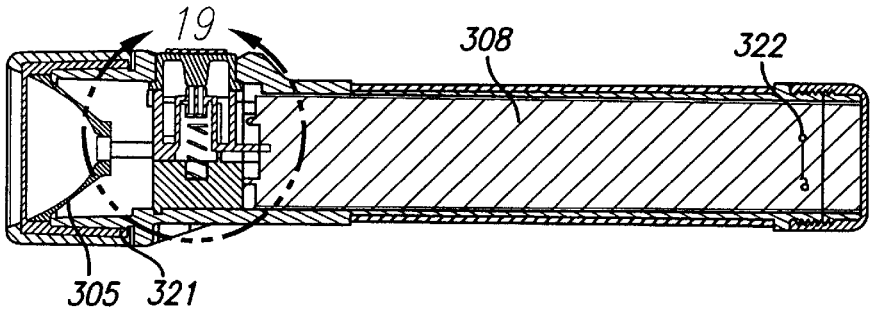
FIG. 15 is a cross-sectional view along line AA of FIG. 14.
Figure 16:
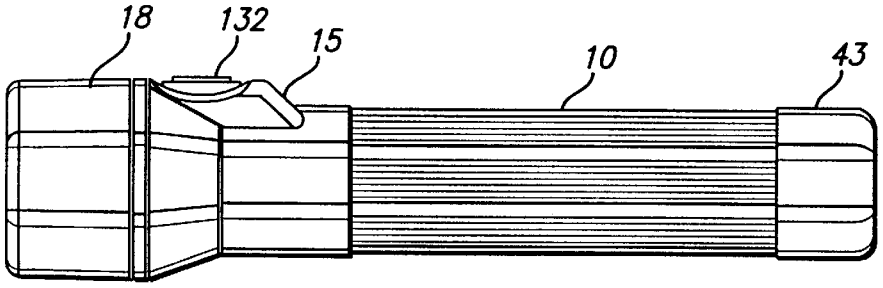
FIG. 16 is a side view of the flashlight body.
Figure 17:
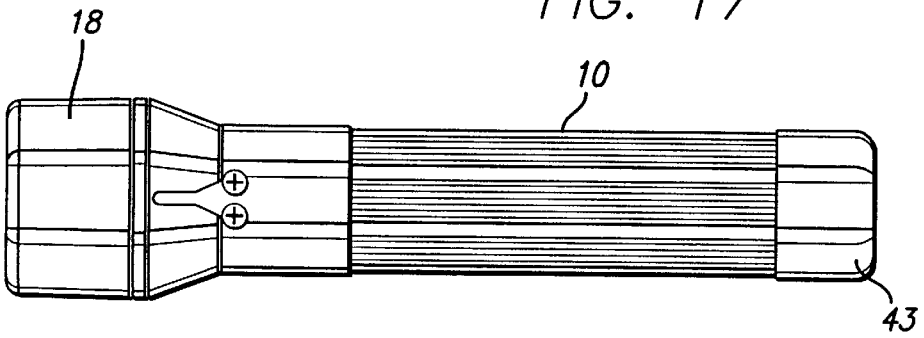
FIG. 17 is an underview of the flashlight body showing the contacts for the charging element.

The charger device includes a mounting plate 46 which has two mounting holes 47, 48 for mounting the charger 46 on a suitable base. An LED 49 indicates the operational status of the charger 46. The charger 46 includes two articulating arms or jaws 50 and 51 which are pivotally mounted to articulate relatively above pivots 52 and 53. The mounting pivots 52 and 53 are of a spring nature and the tip 54 of arm 51 and tip 55 of arm 50 engage the outer surface of the body 10 of the flashlight. A suitable spring acts to cause the articulating arms 50 and 51 to be urged inwardly towards the engaging position as shown in FIG. 6. When the arms 50 and 51 are open as shown in FIG. 7, it is against the spring action and this allows the flashlight to enter into the position whereby the contacts 34 can engage mating contacts 56 which extend outwardly from the charger member. A back plate is held onto the front face of the charger 46 through screws in holes 147, 148 and 149.

The articulating arms 50 and 51 engage the body portion 10 below the intermediate section 15 of the flashlight. The contacts 56 are located on the charger 46 so they engage the contacts 134 which are also positioned below the intermediate section 15 of the flashlight. The contacts 56 are spring loaded to be urged outwardly to engage the contacts 34. The charger 46 includes conventional circuitry to act as a charger. It can be set up for connection with 120 volt main supply or 12 volt DC supply. LED 48 indicates the operational condition of the charger and flashlight.

By having the tips 54 and 55 engage the body of the flashlight in the area 10, namely below the intermediate section 15, the tips and the respective arms 50 and 51 do not have to open and close unduly over a large diameter. The ends of the tips 54 and 55 are shaped to conform with a octagonal formation of the outside surface of the body 10. This permits for engagement in an embracing manner with the body 10. The inside surface 59 of the charger 46 also provides a mating interface with the hexagonal surface 13. As can be seen in FIG. 6, the combination of the mating surface 59 on the body of the charger 46 and the shapes of the arms 50 and 51 are such that seven sides of the octagonal formation 13 are embraced when the body 10 is in position properly in the charger 46. This permits for a firm location of the flashlight 10 in the charger 46 when recharging is to be affected.

Many other forms of the invention exist, each differing from the other in matters of detail only.

For instance, instead of having the contacts 34 located on the body portion 10, namely below the intermediate portion 15, it is possible to have a configuration where the contacts are on the greater cross-sectional area of the intermediate section 15. In other cases, the recharging device may be formed with a mechanism different to the articulating jaws. Only one jaw may articulate, and the other may be stationary in some situations.

In yet different configuration, instead of having the shock-absorbing sleeve extruded around the body 10, the body 10 itself may be formed from material sufficiently sturdy to be resilient to shock. Likewise, there can be situations without a shock-absorbing shroud around the lens. Instead of springs on either side of the rechargeable battery which can be of a nickel-cadmium configuration, there can be different spring formations to provide effective shock absorbing characteristics to either side of the battery.

There is also provided a centering protrusion 200 in the face of the charger 46 for mating with a slot 201 running vertically in the flashlight. This slot and protrusion can be located between the respective contacts 34 and they facilitate alignment of the flashlight in the charger 46.

In FIGS. 14–19 there are shown different views of the flashlight body in accordance with the invention. The components are also itemized as follows:

| No. | Description |
|---|---|
| 301 | Body |
| 302 | Sleeve |
| 303 | Shroud |
| 304 | Lens |
| 305 | Reflector |
| 306 | Switch Cover |
| 307 | Charger Screws |
| 308 | Rechargable Battery |
| 309 | Battery Cap |
| 310 | Switch Base |
| 311 | Switch Cap |
| 312 | Switch Contact |
| 313 | Positive Contact |
| 314 | Negative Contact |
| 315 | Contact Spring |
| 316 | Switch Spring |
| 317 | Switch Plate |
| 318 | Plunger |
| 319 | Spool |
| 320 | Diode |
| 321 | Shroud O-ring |
| 322 | Battery Cap Spring |

Generally, the configuration of the components is of the nature that the units are relatively water impermeable and, in this manner, the configuration of the components are tight fitting and of a material such that the ingress of water into the inner workings and compartments of the battery is relatively difficult under normal and even relatively rugged working conditions.

The invention is to be determined solely upon the following claims.

What is claimed is:

1. A rechargeable flashlight comprising:

a body for receiving a rechargeable battery with a battery top and a battery bottom, the body having a longitudinal axis and a top and a base;

a head on the body having a lens and a bulb;

a switch device with electrical contents, the switch device being between the body and the head portion, the switch device acting to move radially inwardly and outwardly relative to the longitudinal axis of the body to open and close an electrical circuit between the battery and the bulb;

a stud-like first contact member between the switch device and the battery top being part of the electrical circuit;

a first spring in contract with the top of the battery;

a second spring between the battery bottom and the base of the body, the second spring not constituting part of the electric circuit.

2. A flashlight as claimed in claim 1 wherein the first spring is a resilient member for relatively flexible contact with a peripheral zone of the battery.

3. A flashlight as claimed in claim 2 wherein the resilient member is a leaf spring located in a relatively tangential relationship towards the outside circumference of a terminal of a battery, the terminal of the battery being relatively a ring-like shape, and being connected electrically with the base of the battery.

4. A flashlight as claimed in claim 1 wherein the spring between the battery bottom and the base of the body is a helical spring.

5. A flashlight as claimed in claim 1 wherein first contact for the battery is the stud-like contact member located substantially centrally relative to the longitudinal axis of the body.

6. A flashlight as claimed in claim 1 wherein the first spring and the second spring act as a shock absorber effect for the battery located between the first spring and the second spring.

7. A flashlight as claimed in claim 1 wherein the battery includes batteries packed in a series relationship and including an elongated contact extending from a bottom battery to a ring-like element adjacent to the top of a topmost battery, the elongated contact acting to make electrical contact between the bottom battery and the ring-like element such that there are two electrical contacts on top of the battery pack, one contact being the stud-like first contact member, the stud-like front contact member being centrally located, and the other contact being an element peripherally and circumferentially located relative to the battery.

8. A flashlight as claimed in claim 1 wherein the body includes a barrel having a first cross-section and above the barrel there is a portion extending with a second larger cross-section, and above the portion over the second larger cross-section there is a portion with a third larger cross-section, the third larger cross-section being the head on the body.

9. A flashlight as claimed in claim 8 wherein the portion having the second larger cross-section extends generally to one side of the longitudinal axis, and wherein the head extends substantially equally around the longitudinal axis.

10. A flashlight as claimed in claim 9 wherein a second portion also includes a tapered section extending between the top of the barrel and the head portion and there is a tapered portion extending between the base of the second portion and the outside perimeter of the top of the barrel.

11. A flashlight as claimed in claim 1 wherein the body includes a resilient sleeve over a outer portion of the body.

12. A flashlight as claimed in claim 11 wherein the outside surface of the body includes a recessed lip for accommodating the sleeve such that the sleeve is an outside surface which is substantially flush with the surface of the body beyond the sleeve.

13. A flashlight as claimed in claim 8 wherein the second portion of the body includes a radially extending aperture for receiving the switch device such that a manually operable portion of the switch devices extends to the radial aperture and wherein the switch device is operable radially inwardly and outwardly to activate and deactivate the switch.

14. A flashlight as claimed in claim 1 wherein the contacts of the flashlight are on a barrel of the body and below the head.

15. A flashlight as claimed in claim 1 wherein the charger device includes a spaced pair of jaws for receiving the body of the flashlight about the portion of the flashlight constituting the barrel.

16. A flashlight as claimed in claim 1 wherein the flashlight is base loaded with the rechargeable battery.

17. A flashlight as claimed in claim 1 wherein the switch device includes a manually operable switch extending transversely radially from one side of the flashlight and wherein the contacts extend from the opposite side of the flashlight.

18. A rechargeable flashlight comprising:

a body for receiving a rechargeable battery, the body having a longitudinal axis and a top and a base;

a head on the body having a lens and a bulb;

a switch device with electrical contents, the switch device being between the body and the head portion, the switch device acting to move radially inwardly and outwardly relative to the longitudinal axis of the body to open and close an electrical circuit between the battery and the bulb;

a first leaf spring between the switch device and the battery top, and acting as part of the electrical circuit, and a stud-like first contact member between the switch device and the battery top being part of the electrical circuit;

a second spring between the battery bottom and the base of the body, the second spring not constituting part of the electric circuit;

the first spring being a resilient member in relatively flexible contact with a peripheral zone of the battery; and the second spring between the battery bottom and the base of the body being a helical spring.

19. A flashlight as claimed in claim 18 wherein the resilient member is a leaf spring located in a relatively tangential relationship towards the outside circumference of a terminal of a battery, the terminal of the battery being relatively a ring-like shape, and being connected electrically with the base of the battery.

20. A flashlight as claimed in claim 18 wherein the first spring and the second spring act as a shock absorber effect for the battery located between the first spring and the second spring.

21. A flashlight as claimed in claim 18 wherein the battery includes a series of batteries packed in series relationship and including an elongated contact extending from a bottom battery to a ring-like element adjacent to the top of a topmost battery, the elongated contact from the bottom battery acting to make electrical contact between the bottom battery and the ring-like element such that there are two electrical contacts on top of the battery pack, one contact being stud-like first contact member, the stud-like first contact member being centrally located, and the other contact being an element peripherally and circumferentially located.

22. A flashlight as claimed in claim 18 wherein the flashlight is base loaded with the rechargeable battery.

* * * * *